US007028417B2

(12) United States Patent
Tingle

(10) Patent No.: US 7,028,417 B2
(45) Date of Patent: Apr. 18, 2006

(54) THERAPEUTIC SLIPPER

(76) Inventor: Betty J. Tingle, P.O. Box 15, Sikeston, MO (US) 63801

( * ) Notice: Subject to any disclaimer, the term of this patent is extended or adjusted under 35 U.S.C. 154(b) by 0 days.

(21) Appl. No.: 11/185,797

(22) Filed: Jul. 21, 2005

(65) Prior Publication Data

US 2006/0053654 A1 Mar. 16, 2006

Related U.S. Application Data

(60) Provisional application No. 60/609,873, filed on Sep. 15, 2004.

(51) Int. Cl.
*A43B 7/02* (2006.01)

(52) U.S. Cl. ..... 36/9 R; 36/2.6; 36/136

(58) Field of Classification Search ..... 36/9 R, 36/2.6, 136, 54, 1.5
See application file for complete search history.

(56) References Cited

U.S. PATENT DOCUMENTS

| | | | | |
|---|---|---|---|---|
| 2,675,630 A | | 4/1954 | Youmans | |
| 4,023,282 A | * | 5/1977 | Ziegelheafer | 36/2.6 |
| 4,094,080 A | | 6/1978 | Sanders | |
| 4,249,319 A | | 2/1981 | Yoshida | |
| 4,373,274 A | | 2/1983 | Michalski | |
| 4,644,673 A | | 2/1987 | Gamm | |
| 4,726,126 A | * | 2/1988 | Bernhard | 36/89 |
| 4,841,646 A | | 6/1989 | Maurer | |
| 5,050,598 A | | 9/1991 | Tucker | |
| 5,230,333 A | | 7/1993 | Yates et al. | |
| 5,300,104 A | | 4/1994 | Gaudreault et al. | |
| 5,339,541 A | | 8/1994 | Owens | |
| 5,357,693 A | | 10/1994 | Owens | |
| 5,400,529 A | | 3/1995 | Bell et al. | |
| D369,458 S | | 5/1996 | Adams | |
| 5,591,221 A | | 1/1997 | Owens | |
| 5,673,448 A | | 10/1997 | Lang et al. | |
| D433,758 S | | 11/2000 | Allen | |
| 6,434,859 B1 | | 8/2002 | Kim | |
| 6,532,689 B1 | | 3/2003 | Jones, Jr. | |
| 6,576,003 B1 | | 6/2003 | Kotack | |
| 6,601,323 B1 | * | 8/2003 | Tsujino et al. | 36/136 |
| 6,895,696 B1 | * | 5/2005 | Sanders | 36/54 |
| 2004/0250445 A1 | * | 12/2004 | Pritchett | 36/2.6 |

FOREIGN PATENT DOCUMENTS

| | | |
|---|---|---|
| DE | 3342276 | 6/1985 |
| DE | EP 0146792 | 7/1985 |
| DE | 3544856 | 10/1986 |

(Continued)

*Primary Examiner*—Marie Patterson
(74) *Attorney, Agent, or Firm*—Richard C. Litman

(57) ABSTRACT

The therapeutic slipper is a footwear article for slidably receiving a foot, the slipper having a sole, a vamp panel joined to the sole, a toe panel disposed over the vamp panel, a front toe pocket, a quarter panel joined to the sole and at least one rear pocket. The vamp portion is disposed over the toes and covers a lower instep of the foot; the quarter panel covers the sides of the foot, the heel, and the ankle region. The slipper may be used alone or in conjunction with a removably attachable instep panel, having an instep pocket. When the slipper is used with the instep panel, the entire foot is covered and the entire ankle encircled. The front toe pocket, the rear pocket and the instep pocket are designed to receive therapeutic devices that will disseminate a particular effect over different regions of the foot and help relieve foot pain.

6 Claims, 6 Drawing Sheets

FOREIGN PATENT DOCUMENTS

| | | |
|---|---|---|
| DE | EP 0350517 | 1/1990 |
| EP | 0040189 | 11/1981 |
| FR | EP 0341141 | 11/1989 |
| FR | EP 0383685 | 8/1990 |

* cited by examiner

THERAPEUTIC SLIPPER

CROSS-REFERENCE TO RELATED APPLICATION

This application claims the benefit of U.S. Provisional Patent Application Ser. No. 60/609,873, filed Sep. 15, 2004.

BACKGROUND OF THE INVENTION

1. Field of the Invention

The present invention relates to footwear, and more particularly to therapeutic slippers used in conjunction with hot or cold packs to relieve foot pain.

2. Description of the Related Art

Foot problems such as swelling, cold feet, or burning feet, are aliments that affect a wide variety of individuals including the elderly, athletes and those who stand on their feet for prolonged periods of time. Though causes for these foot problems are numerous and varied, methods of alleviating these problems can be as simple as wearing insulated foot apparel for individuals having cold feet, or soaking the feet for individuals having foot swelling or temperature problems in the feet.

Problems associated with soaking the feet include requiring the individual to be seated and splashing water onto clothes or on the floor. Applying hot or cold packs allows a person greater freedom than when soaking one's feet; however, it is still problematic as a result of having to hold or strap the pack to the foot.

Some footwear has been developed that incorporates hot or cold therapeutic devices directly into compartments of footwear. These therapeutic devices are either removably placed or are fixed within regions of the footwear. Other footwear has been developed to warm or cool the feet through the outside body of the footwear by placing hot or cold emitting devices directly on the footwear. However, a need exists for footwear that can selectively receive and removably hold hot or cold therapeutic devices at the toes, the vamp area and the ankle, heel and sides of the feet. The footwear should also be able to be used without restricting a user's movement. Thus a therapeutic slipper solving the aforementioned problems is desired.

SUMMARY OF THE INVENTION

The therapeutic slipper is a footwear article for slidably receiving a foot and comprises a sole, a vamp panel joined to the sole, a toe panel disposed over the vamp panel forming a front toe pocket, and a quarter panel joined to the sole having an inner quarter panel layer and an outer quarter panel layer forming at least one rear pocket. The vamp portion is disposed over the toes and covers a lower instep of the foot, while the quarter panel covers the sides of the foot, the heel and ankle regions.

The front toe pocket and the rear pocket are designed to receive therapeutic devices, such as cold packs or heating pads, as well as other therapeutic articles, such as satchels of herbal compositions or magnets. The pockets are secured by fasteners, which may comprise hook and loop material, buttons, snaps, or any other form of securing or closure means. The therapeutic devices are placed in the pockets to disseminate a particular effect over the area of the foot the pocket is disposed over to help relieve foot pain.

An instep panel can be removably attached to the slipper, specifically to the vamp panel and the portion of the quarter panel that is disposed over the ankle region. The instep panel has an instep pocket that is also designed to receive therapeutic devices. Once secured to the slipper, the instep panel rests over the instep of the foot, just above the metatarsal region and the front of the ankle of a user. The instep pocket, like the front toe pocket and the rear pocket on the slipper, is held closed by fasteners, which may comprise hook and loop material, button, snaps, or any other form of securing or closure means.

The slipper may be used alone or in conjunction with the instep panel to cover the foot and encircle the entire ankle. The therapeutic devices may be selectively placed in the front toe pocket, the instep pocket, or the rear pocket in order to disseminate a particular effect to the region of the foot the pocket is disposed over. Both the slipper and the instep panel are made from durable, breathable material that can be machined-washed between uses. Alternatively, the slipper may be made of leather, fabric, or other material commonly used to make house slippers. The sole of the slipper may be made of the same material the slipper is made of and may be a non-slip material or have a non-slip material attached to the sole to provide added strength and safety to the slipper and to cushion the feet.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
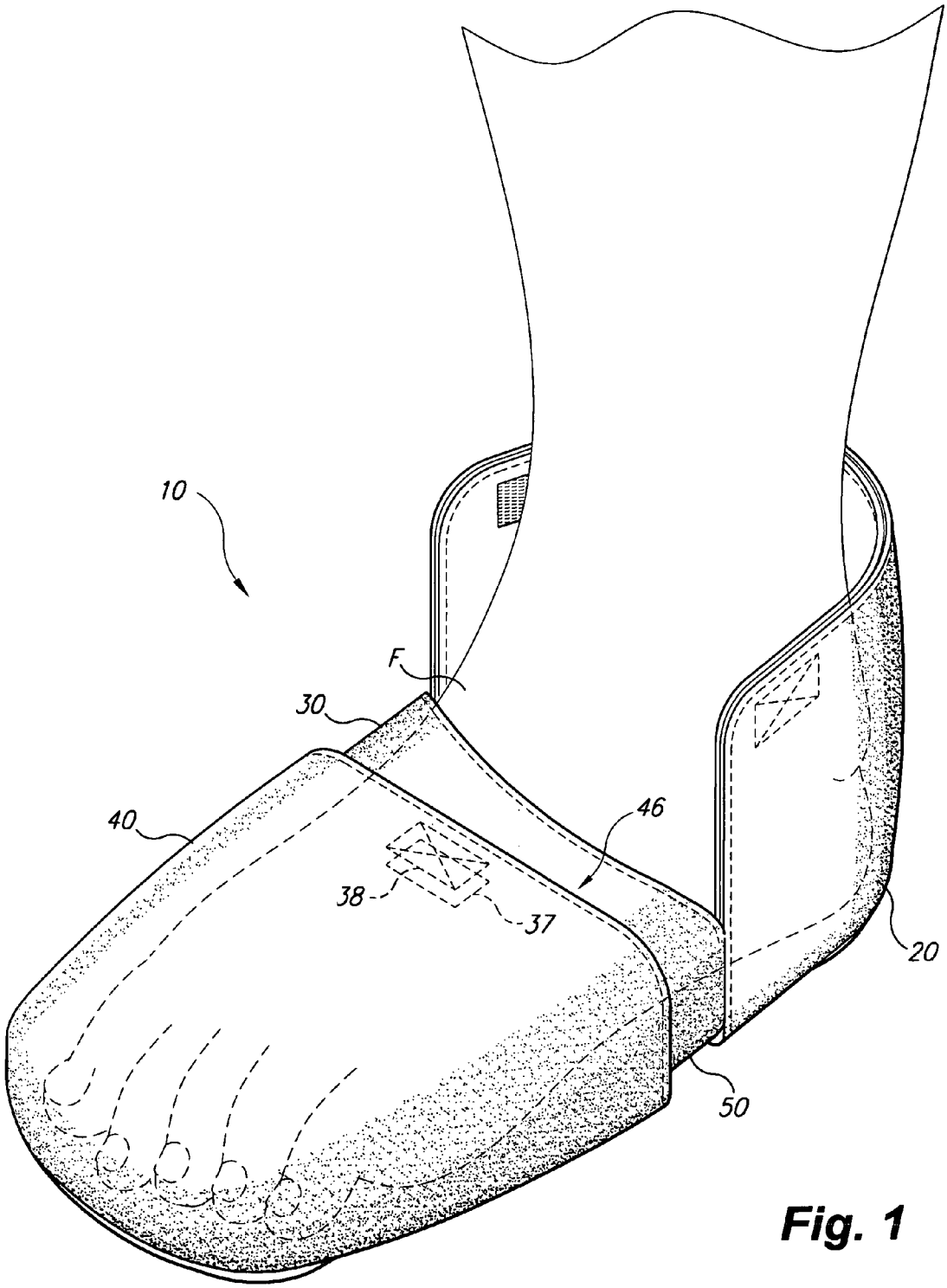
FIG. 1 is an environmental, perspective view of a therapeutic slipper according to the present invention.
Figure 2:
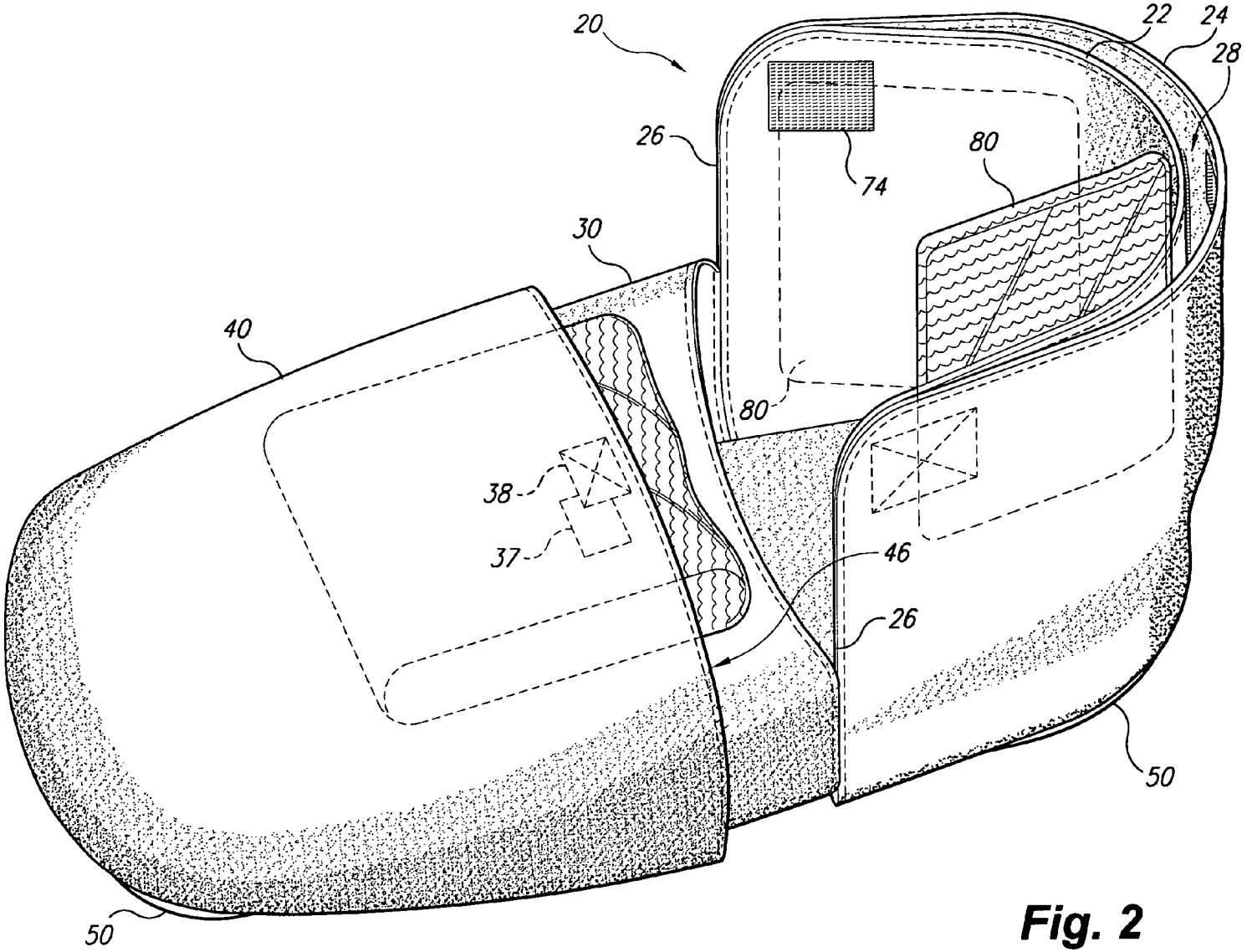
FIG. 2 is a side perspective view of the therapeutic slipper according to the present invention.
Figure 3:
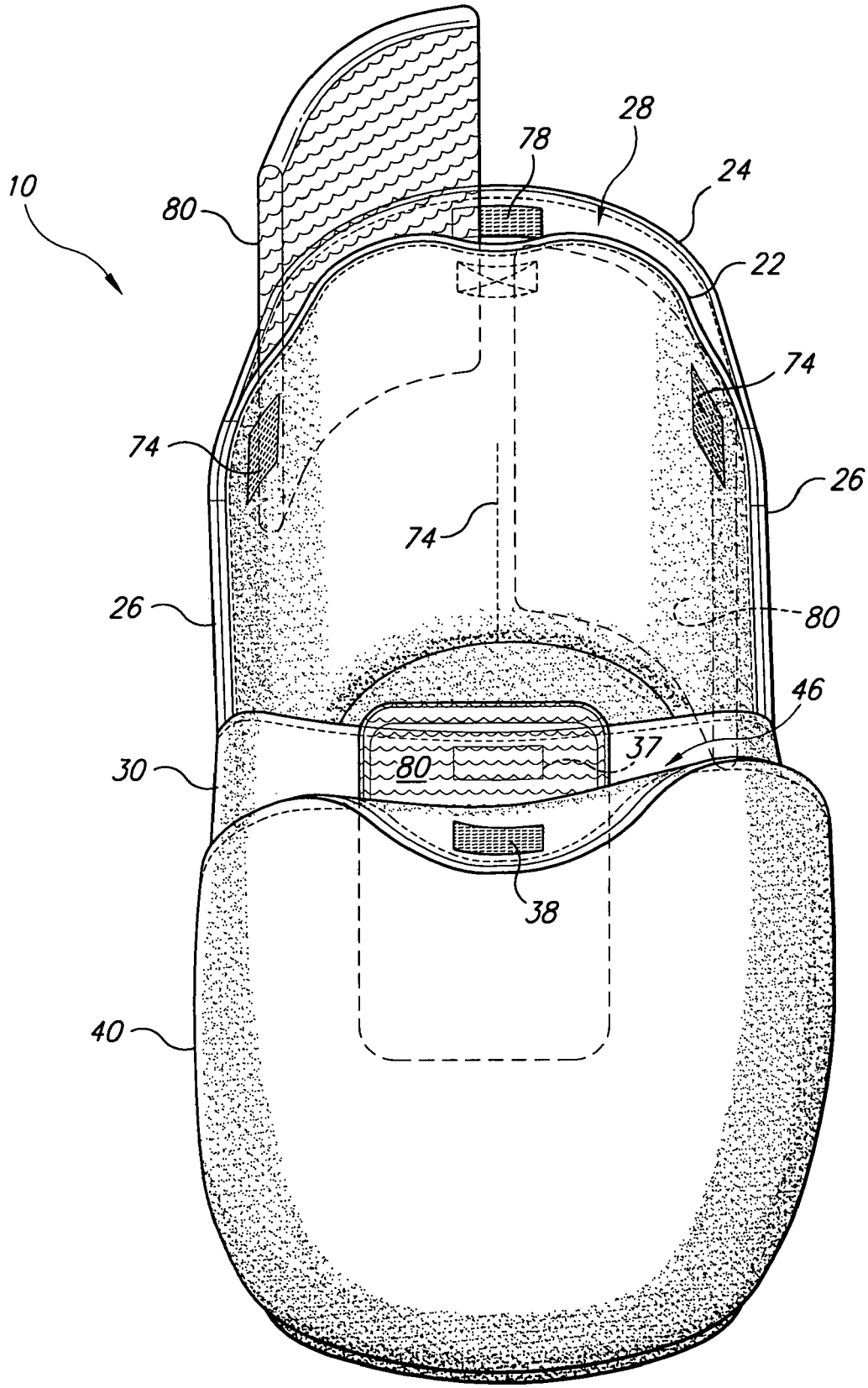
FIG. 3 is a front perspective view of the therapeutic slipper according to the present invention.

The present invention is a therapeutic slipper, designated as 10 in the figures. As shown in FIGS. 1–3, the therapeutic slipper 10 is worn on a foot F of a user. The slipper 10 has a sole 50, a vamp panel 30 joined to the sole 50, a toe panel 40 disposed over the vamp panel 30, a front toe pocket 46, a quarter panel 20 and a rear pocket 28.

The vamp panel 30 is disposed over the toes and lower instep of the foot. The toe panel 40 is disposed over the vamp panel 30 to form at least one front toe pocket 46. The front toe pocket 46 may be a single pocket or multiple pockets split by seams. In the drawings, front toe pocket 46 is shown with only one compartment. An open end of the front toe pocket 46 is secured closed by mating fasteners 37, 38. Fastener 38 is disposed on the toe panel 40 and fastener 37 is disposed on the vamp panel 30 for releasably closing the open end of the front toe pocket 46 to the vamp panel 30. The fastener 37, 38 may be any releasably securable fastener, such as a hook and loop fastener, a button and buttonhole, snaps, etc.

Referring now to FIGS. 2–3, the quarter panel 20 is designed to cover the heel, ankle and rear sides of the foot.

The quarter panel 20 is U-shaped to conform to the shape of the foot and has a heel end and two medial ends 26. Each medial end 26 has an upper portion and a lower portion. The lower portions of the medial ends 26 are joined to the vamp panel 30. The upper portions cover the sides and back of the ankle. Means for receiving an instep panel 74 are disposed at the upper portion of the medial ends 26. The means for receiving the instep panel 74 may be any type of releasably securable fastener, such as a hook and loop fastener, a button and buttonhole, snaps, etc.

The quarter panel 20 is made up of an inner quarter panel layer 22 and an outer quarter panel layer 24 that form the rear pocket 28. The rear pocket 28 may be a single pocket or multiple pockets split by seams, fasteners, and the like. In the drawings, a fastener 78 splits the rear pocket 28 into two compartments. The fastener 78 is disposed between the inner quarter panel layer 22 and the outer quarter panel layer 24 for releasably closing an open edge of the rear pocket 28. The fastener 78 may be any releasably securable fastener, such as a hook and loop fastener, a button and buttonhole, snaps, etc.

The front toe pocket 46 and the rear pocket 28 are designed to removably receive therapeutic devices 80, such as hot packs, cold packs, and satchels of herbal compositions or magnets. The therapeutic devices 80 are secured in the slipper 10 by fasteners 38, 78. The therapeutic devices 80 may be placed in both the front toe pocket 46 and the rear pocket 28, or selectively placed in either of the pockets 46, 28. The therapeutic devices 80 are placed in the pockets 46, 28 to target the respective area that the therapeutic device 80 is placed over, such as the toes or the rear of the foot, to help relieve foot pain.

Figure 6:
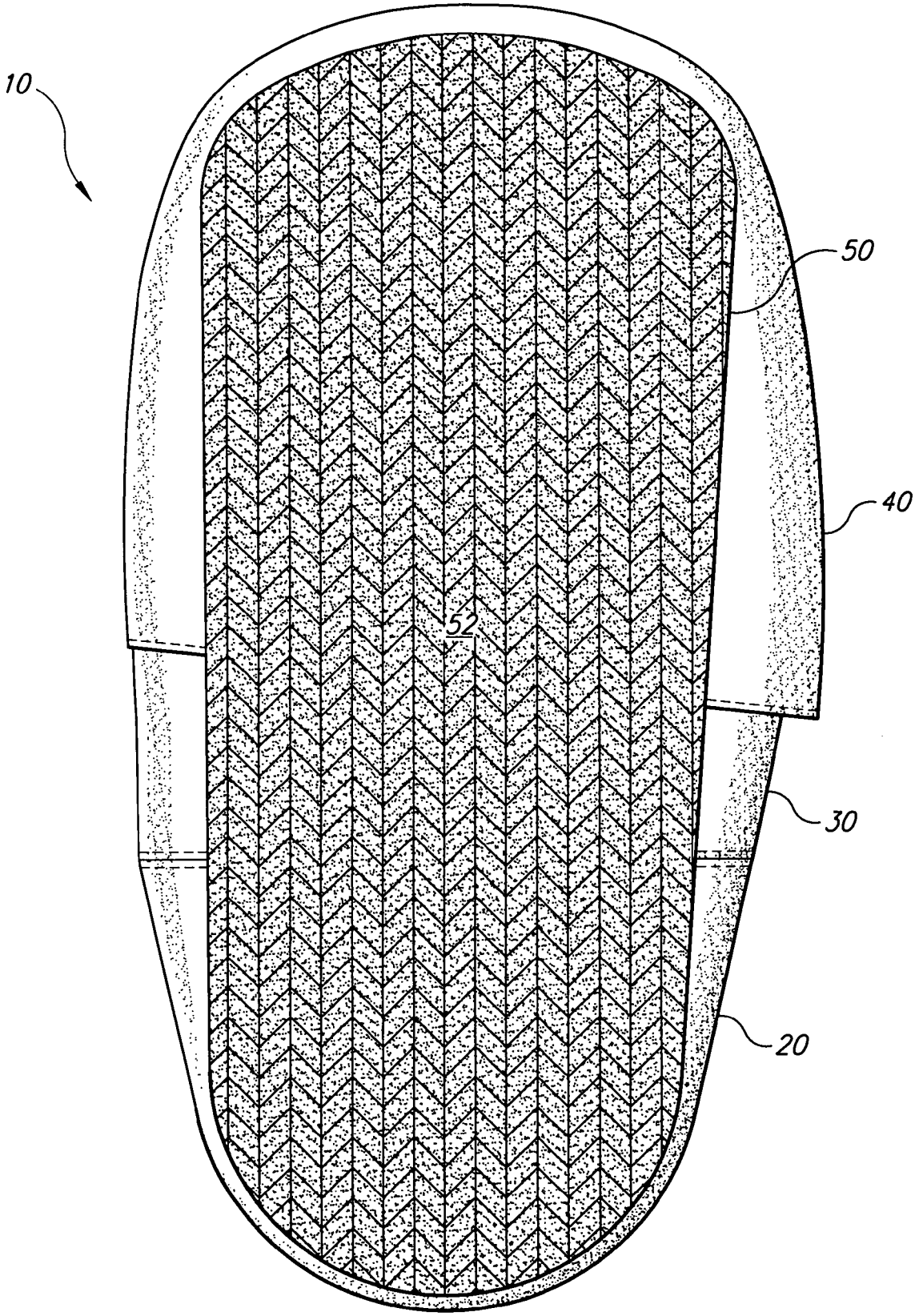
FIG. 6 is a bottom view of the therapeutic slipper according to the present invention.

Referring to FIGS. 1 and 6, the sole 50 of the slipper 10, is shown to have a non-slip material 52. The non-slip material 52 provides added safety and strength to the slipper 10 and may provide some degree of cushioning to the feet. The vamp panel 30, the toe panel 40 and the quarter panel 20 are joined to the sole 50 to provide a foot cavity and slidably receive the foot F of the user. The slipper 10 may be used alone or in conjunction with an instep panel 60 to cover the entire foot and encircle the entire ankle. Both the slipper 10 and the instep panel 60 are made from durable, breathable material that can be machined-washed between uses. Alternatively, the slipper may be made of leather, fabric or other material commonly used to make house slipper.

Figure 4:
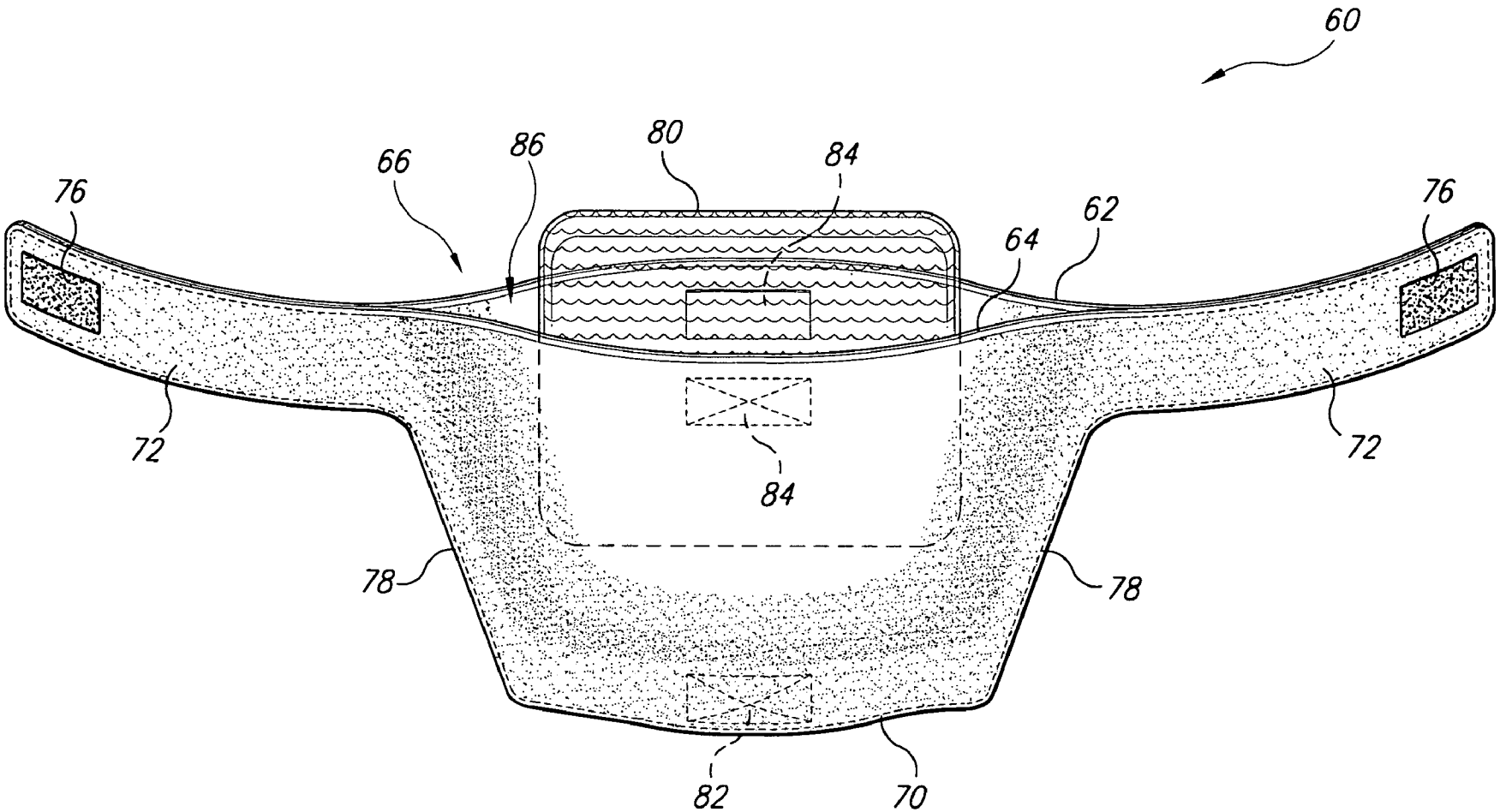
FIG. 4 is a front perspective view of an instep panel according to the present invention.
Figure 5:
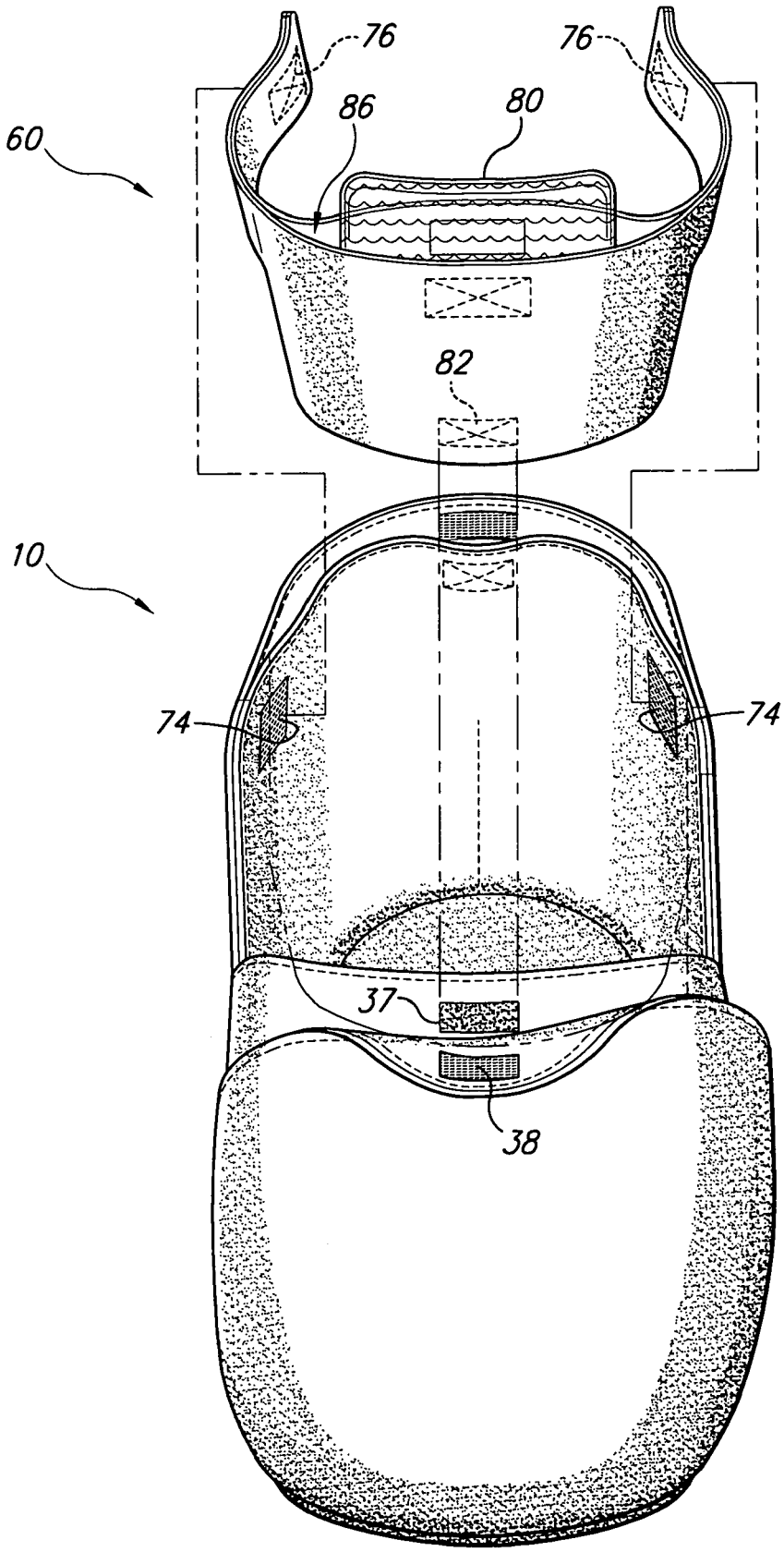
FIG. 5 is a front, exploded view of the therapeutic slipper and the instep panel according to the present invention.

Referring now to FIGS. 4 and 5, the instep panel 60 for use with the slipper 10 is shown. The instep panel 60 has an inner instep panel layer 62, an outer instep panel layer 64, a top end 66, a bottom end 70, two side edges 78 and two side tabs 72 extending from each side edge 78. The two side tabs 72 are disposed adjacent the top end 66 of the instep panel 60 and have fastener 76 attached thereto. Fasteners 76 may be any type of releasably securable fastener, such as a hook and loop fastener, a button or buttonhole, snaps, etc. that corresponds to the means for securing the instep panel 74 disposed at the medial ends 26 of the quarter panel 20.

The inner instep panel layer 62 and the outer instep panel layer 64 form an instep pocket 86 that removably receives the therapeutic devices 80 mentioned above. The instep pocket 86, like the pockets 28, 46 of the slipper 10, is designed to hold a therapeutic device 80 or devices, and is held closed by fastener 84, such as hook and loop material, button and buttonhole, snaps, etc. The bottom end 70 of the instep panel 60 has a fastener 82 that corresponds to fastener 37 on the vamp panel 30.

When the instep panel 60 is used with the slipper 10, fastener 82 at the bottom end 70 of the instep 60 is removably attached to the fastener 37 on the vamp panel 30 and fastener 76 is removably attached fasteners disposed at the medial ends 26 of the quarter panel 20. The instep pocket 86 is designed to rest over the instep of the foot, just above the metatarsal region, and the front ankle of the user.

In another embodiment (not shown), the therapeutic device may be preformed within the pocket, thereby obviating the need for closure means.

It is to be understood that the present invention is not limited to the embodiments described above, but encompasses any and all embodiments within the scope of the following claims.

I claim:

1. A therapeutic slipper, comprising:

a sole;

a vamp panel joined to the sole;

a toe panel disposed over the vamp panel, forming at least one front toe pocket adapted for removably receiving a therapeutic device;

a quarter panel disposed on the sole, the quarter panel having a heel end and two medial ends, the medial ends having an upper portion and a lower portion, the lower portion of the medial ends being joined to the vamp panel;

a releasable fastener disposed on the quarter panel; and an instep panel having an inner instep panel layer, an outer instep panel layer, a top end, a bottom end, two side edges and two side tabs extending from each of the side edges, the side tabs being removably attachable to the releasable fastener disposed on the quarter panel, the inner instep layer and the outer instep layer being joined together to form an instep pocket for removably receiving a therapeutic device, the toe panel, the vamp panel, the quarter panel, the instep panel, and the sole being joined together to form a slipper for slidably receiving a foot.

2. The therapeutic slipper as claimed in claim 1, further comprising means for releasably closing the toe pocket.

3. The therapeutic slipper as claimed in claim 1, wherein the quarter panel comprises an inner quarter panel layer and an outer quarter panel layer forming a rear pocket adapted for receiving a therapeutic device.

4. The therapeutic slipper as claimed in claim 3, further comprising means for releasably closing the rear pocket.

5. A therapeutic slipper, comprising:

a sole;

a vamp panel joined to the sole;

a toe panel disposed over the vamp panel, forming at least one front toe pocket for removably receiving a therapeutic device;

a quarter panel attached to the sole, the quarter panel having a heel end and two medial ends, the medial ends having an upper portion and a lower portion, the lower portion of the medial ends being joined to the vamp panel, the toe panel, the vamp panel, the quarter panel, and the sole forming a slipper for slidably receiving a foot; and an instep panel removably attached to the quarter panel, the instep panel having an inner instep panel layer and an outer instep panel layer joined together on opposing sides to form an instep pocket adapted for removably receiving a therapeutic device.

6. The therapeutic slipper as claimed in claim 5, wherein the quarter panel comprises an inner quarter panel layer and an outer quarter panel layer forming a rear pocket adapted for receiving therapeutic devices.

* * * * *